US006237645B1

(12) United States Patent
Pountney

(10) Patent No.: US 6,237,645 B1
(45) Date of Patent: May 29, 2001

(54) BOAT FUEL OVERFLOW PROTECTION SYSTEM

(76) Inventor: David B. Pountney, 49 Ironworks Rd., Clinton, CT (US) 06413

( * ) Notice: Subject to any disclaimer, the term of this patent is extended or adjusted under 35 U.S.C. 154(b) by 0 days.

(21) Appl. No.: 09/640,547

(22) Filed: Aug. 17, 2000

(51) Int. Cl.[7] ..... B65B 31/00; B67C 3/00

(52) U.S. Cl. ..... 141/7; 141/4; 141/5; 141/37; 141/59; 141/66; 141/285; 141/301; 137/587

(58) Field of Search ..... 141/4–7, 37, 44, 141/59, 66, 86, 87, 115, 121, 126, 301, 285, 309, 311 R, 324, 325, 346, 383, 311 A; 137/583, 584, 587

(56) References Cited

U.S. PATENT DOCUMENTS

| | | | | |
|---|---|---|---|---|
| 4,082,125 | | 4/1978 | Wilson et al. . | |
| 4,502,516 | * | 3/1985 | Shields | 141/290 |
| 4,802,514 | | 2/1989 | Morse . | |
| 5,070,806 | | 12/1991 | Coster . | |
| 5,230,372 | | 7/1993 | Westphal . | |
| 5,322,099 | | 6/1994 | Langlois . | |
| 5,469,800 | | 11/1995 | Brotz . | |
| 5,634,505 | * | 6/1997 | Wong | 141/349 |
| 5,762,114 | | 6/1998 | Petersen . | |
| 5,850,858 | | 12/1998 | Zeigler . | |
| 5,894,809 | | 4/1999 | Grigaitas et al. . | |

* cited by examiner

*Primary Examiner*—Timothy L. Maust

(57) ABSTRACT

Apparatus and method to prevent fuel spillage from a fuel tank vent used with a boat mounted fuel tank having a filler tube leading thereto from a fuel filler fitting mounted to a surface of the boat and a vent line leading from the fuel tank to a vent extending through the hull of the boat. A member having a hollow interior and a removable closure member is mounted substantially flush with a surface of the boat and in close proximity to the fuel filler fitting. The member has a fitting in the interior thereof which is connected to a first section of vent tube leading from the fuel tank. The interior of the member is also connected to a second section of vent tube that leads to the vent extending through the hull of the boat. When the closure is on the member, the interior of the fuel tank is in communication with the vent. When the boat is to be fueled, the cap is removed from the member and a fuel overflow container is connected to the fitting. Then the interior of the fuel tank is in communication with the container and any fuel overflow from the first section of vent tubing is collected in the container. When fueling is complete, the collection container fitting is removed from the first mentioned fitting and the closure member is replaced on the member. The interior of the fuel tank is then in communication, through the first and second sections of vent tubing, with the hull-mounted vent.

15 Claims, 4 Drawing Sheets

BOAT FUEL OVERFLOW PROTECTION SYSTEM

FIELD OF THE INVENTION

This invention relates to a relatively simple, easily installable apparatus and system for preventing fuel spillage and loss when fueling a boat.

BACKGROUND OF THE INVENTION

Motorized boats are usually refueled at a dockside pump, which operates at a high pressure to attempt to quickly fill the fuel tank. Such pumps usually include sensing devices to shut off the pump when the fuel tank is full. However, it is not uncommon for the tank to overfill and force some fuel through a vent in the hull, which is connected by a vent line to the fuel tank. It is generally mandated that a boat fuel tank be vented to a location outside the boat hull to prevent build-up of fuel vapors, which may become explosive, inside the hull. The spillage from a single boat may be insignificant. However, at a marina fuel dock where boats are continuously being fueled throughout a day the cumulative spillage and resultant water pollution and contamination becomes significant.

Dependent on the boat design, the fuel vent may be located quite remote from the fuel tank. Typically, a vent fitting is mounted to extend through the boat hull and has a downwardly directed opening. The vent fitting is connected to the fuel tank through piping or a tube to the fuel tank. Discharge of fuel into the water is not environmentally acceptable. However, some fuel may be discharged through the vent at time of fueling, this is a major cause of water pollution at marinas. Such discharge, particularly at the time of fueling, has long been recognized and many structures and devices have been proposed to attempt to prevent such spillage from entering the water. The most simple of such devices have been the provision of apparatus device that is removably attached to the boat hull to catch or absorb the fuel exiting the vent. Examples of such devices are found disclosed in U.S. Pat. Nos. 4,082,1255; 230,372; 5.469,800; and 5,850,858. U.S. Pat. No. 5,762,114 also discloses a vent attachment apparatus in a more complex form.

These known arrangements require storage of the attachment device, retrieval at the time of fueling, attachment to the boat hull or vent, detachment from the boat hull or vent after fueling, disposal of captured fuel and returning the device to storage. These are tasks the fueling attendant does not have time to or will not undertake and must be performed by the boat owner. These arrangements concentrate on capturing fuel overflow at the vent.

Other fueling systems have been proposed which include a fuel overflow catch basin in or associated with a vent line where fuel overflow is captured and returned through additional piping to the fuel tank. Examples of such fueling systems are found in the disclosures of U.S. Pat. Nos. 5,322,099 and 5,894,809. These proposals require a redesign of conventional fueling and fuel tank venting systems which a boat manufacturer will not want to undertake due to the expenses of additional components and installation.

Accordingly, the present invention provides a new and improved boat fuel overflow protection system which is easily and economically installed on a boat during manufacture, and which is also easily and economically added to most existing boats at little expense. The invention permits the installation of efficient vent overflow protection with minimal additional parts and little expenditure of time.

An object of this invention is to provide a new and improved fuel overflow protection system for boats.

Another object of this invention is to provide a new and improved boat overflow protection system that may be quickly and conveniently installed in a boat fuel tank venting system.

A further object of the invention is to provide a boat fuel vent overflow protection system that may be easily operated by a fueling attendant.

A still further object of this invention is to provide a new and improved device and method for venting the interior of a boat fuel tank to a fuel collection container while the boat is being fueled.

SUMMARY OF THE INVENTION

Briefly stated, the invention, in one form thereof, comprises apparatus to prevent fuel spillage from a fuel tank vent in combination with a boat mounted fuel tank having a filler tube leading thereto from a deck plate type fuel filler fitting mounted to a surface of the boat and a vent line leading from the fuel tank to a vent extending through the hull of the boat A member having a hollow interior which may be generally cup-shaped and has a removable cap is mounted substantially flush with a surface of the boat, and in close proximity to the fuel filler fitting. The member has a fitting in the interior thereof which is connected to a first section of vent tube leading from the fuel tank. The interior of the member is also connected to a second section of vent tube, which leads to the vent extending through the hull of the boat. When the cap is on the member, the interior of the fuel tank is in communication with the vent. When the boat is to be refueled, the cap is removed from the member and a fuel collection container having a line with a second fitting complimentary to the first mentioned fitting is connected to the first mentioned fitting. Then the interior of the fuel tank is in communication with the container and any fuel overflow from the first section of vent tubing is collected in the container. When fueling is complete, the collection container fitting is removed from the first mentioned fitting and the cap is replaced on the member. The interior of the fuel tank is then in communication, through the first and second sections of vent tubing, with the hull-mounted vent.

The invention is particularly pointed out and distinctly claimed in the concluding portion of this specification. The invention, however, together with further objects and advantages thereof, may be best appreciated by reference to the following detailed description taken in conjunction with the drawings.

DETAILED DESCRIPTION OF PREFERRED EMBODIMENTS OF THE INVENTION

Figure 1:
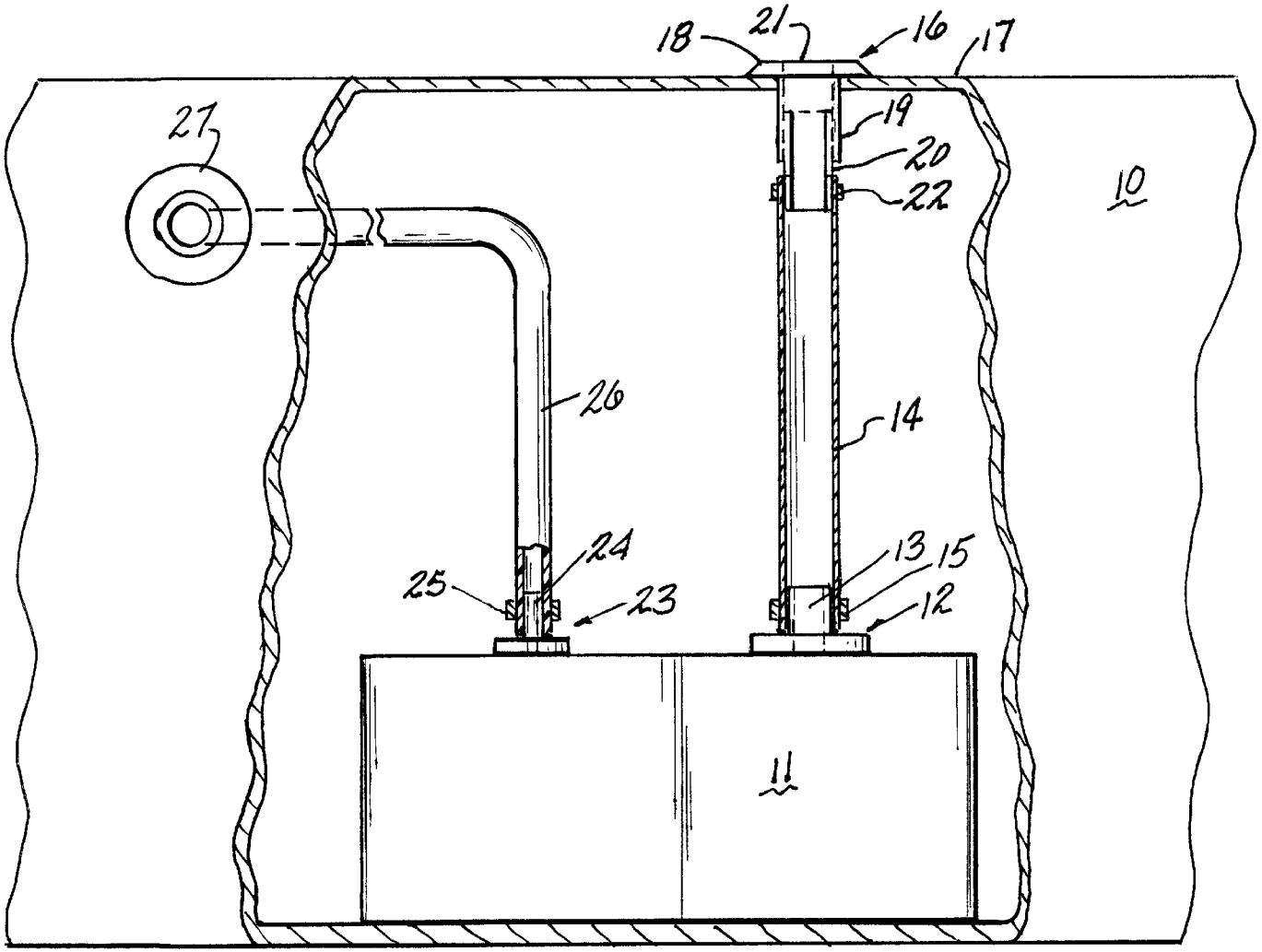
FIG-1 PRIOR ART
FIG. 1 is a side elevation of a portion of a boat hull, partially cut away to show a conventional arrangement of a fuel tank, fuel filler tube, vent and connection of the vent to the fuel tank.

FIG. 1 illustrates a typical boat fueling system. A boat hull 10 is partially depicted in which is positioned a fuel tank 11, which supplies fuel to an inboard engine, not shown. Tank 11 has a fitting 12 thereon including a sleeve or nipple 13 which receives a fuel filler tube 14 secured to sleeve 13 by a clamp 15. Fuel filler line 14 extends to fuel deck type fuel filler fitting 16 mounted to the gunwale 17 of boat 10. Fitting 16 comprises a mounting flange 18 and an internally threaded depending sleeve or cylindrical portion 19 which receives the upper end of a filler tube nipple 20. A cap 21 is threadably received in fitting 16. Filler tube 14 extends about nipple 20 and is secured thereto by a clamp 22. Flange 18 is supported on and fastened to gunwale 17 as hereinafter made apparent. The construction thus far described supposes a flexible filler tube 14. Alternatively, filler tube 14 may be a formed rigid member with threaded ends which are received in mating internal threads in fitting 12 and fuel filler fitting 16.

Another fitting 23 on tank 11 has a nipple or sleeve 24 which receives a vent line 26 leading to a vent fitting 27 which extends through the hull of the boat and vents the interior of tank 11 to the ambient atmosphere. A clamp 25 secures vent line 26 to nipple 24. Vent fittings are well known and need not be illustrated in detail. A typical vent fitting is shown in detail in U.S. Pat. No. 4,082,125. The vent fitting 27 may be located anywhere in the hull of the boat dependent on the choice of the boat designer and/or manufacturer.

Figure 2:
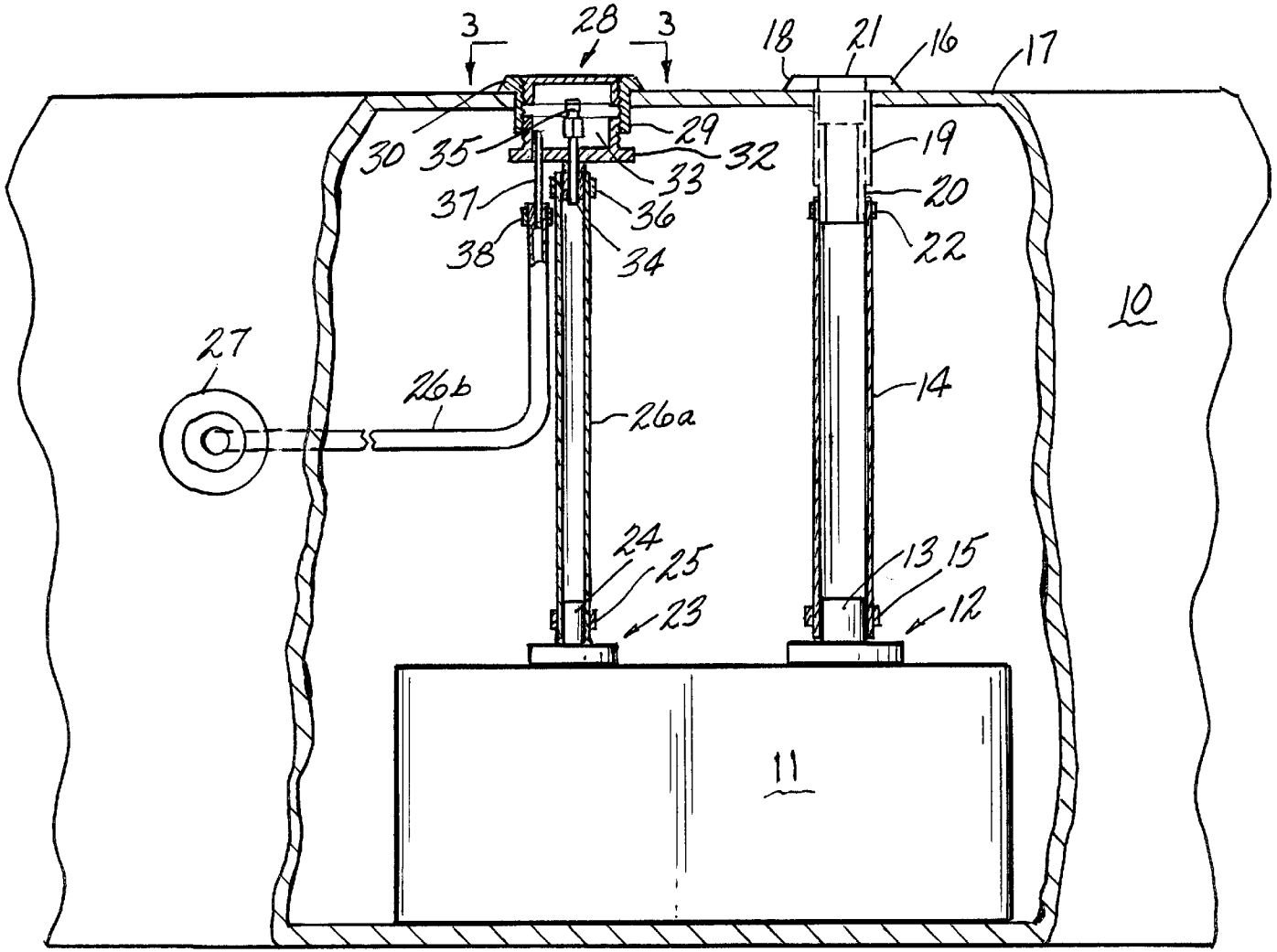
FIG. 2 is a view similar to FIG. 1 and showing a fuel tank venting arrangement embodying the invention.
Figure 3:
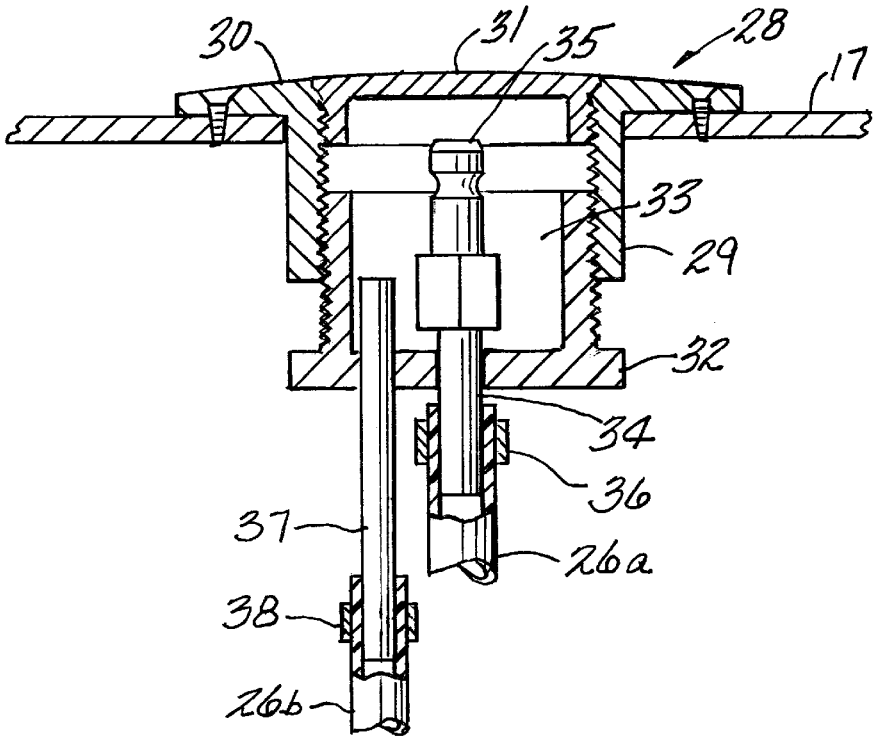
FIG. 3 is a sectional view seen in the plane of lines 3—3 of FIG. 2.

Reference is now made to FIG. 2, which is similar to FIG. 1 and in addition shows the inclusion of a device or apparatus embodying the invention into the fuel tank vent system of FIG. 1. Reference is also made to FIG. 3 in conjunction with FIG. 2. The vent line or tube 26 is now made in two sections or lengths 26*a* and 26*b*. A member 28 is provided which is similar, in part, to deck plate type fuel filler fitting 16. Member 28 comprises an internally threaded cylindrical portion 29 depending from a flange 30 supported and secured to gunwale 17. A cap 31 is threaded in member 28. An adapter member 32 in the form of a conventional pipe end piece is threadably received in cylindrical portion 29 and closes the bottom of member 28 to form a generally hollow interior cup-shaped member 33. Extending substantially centrally through end piece 32 is first tubular member or a nipple 34. Connected to the upper end of nipple 34 is a portion of a coupling, shown as the male portion 35 of a bayonet type, quick-disconnect coupling. Connected to the lower end of nipple 34 is a first section 26*a* of the vent line from fuel tank 11, and secured thereto by a clamp 36 (FIG. 3). Also extending through end piece 32 is a second tubular member or nipple 37 that terminates at an upper end within cup-shaped member 33. The lower end of tube 37 is connected to vent line section 26*b*, which in turn is connected to vent fitting 27. A clamp 38 secures vent tube 26*b* to tube 37.

The hollow interior of cup-shaped member 33 is closed by a cap or closure member 31 which is threaded into member 28.

With the arrangement shown in FIGS. 2 and 3, it will be seen that the interior of fuel tank 11 is vented through vent line 26*a,* member 33 and vent line 26*b* to vent fitting 27.

Figure 4:
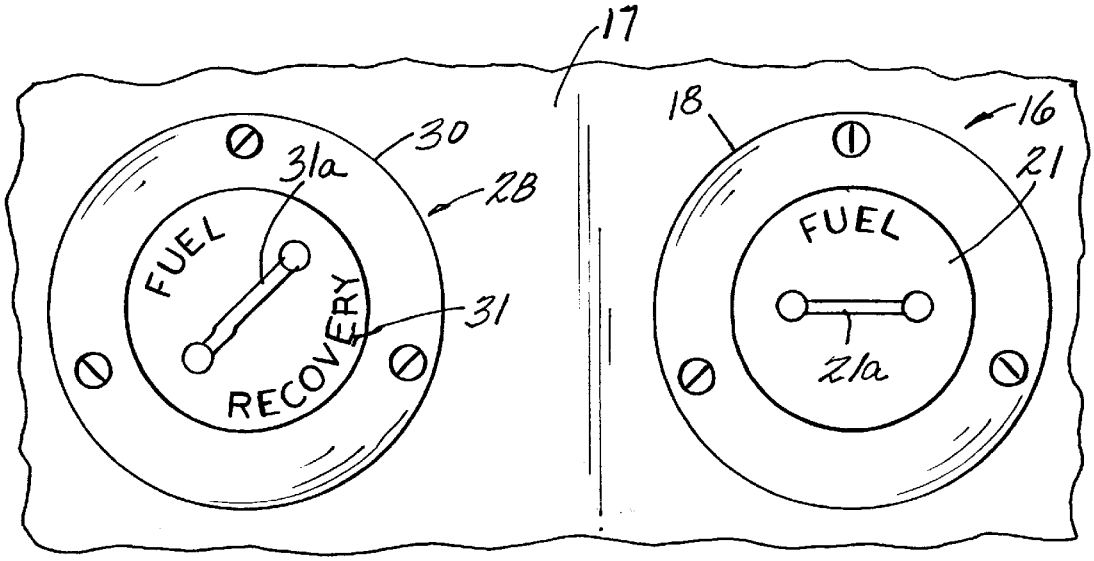
FIG. 4 is a plan view of a portion of a boat gunwale as seen in FIG. 2.

As a feature of the invention the member 33 is located in close proximity to fuel filler fitting 16, as exemplified in FIGS. 2 and 4. When it is desired to fuel the tank 11, the caps 21 and 31 are removed by the fueling attendant at a marina fueling dock. The caps are typically provided with slots 21*a* and 31*a* to receive a turning tool. As shown in FIG. 4, the caps 21 and 31 are conveniently marked for identification.

Figure 5:
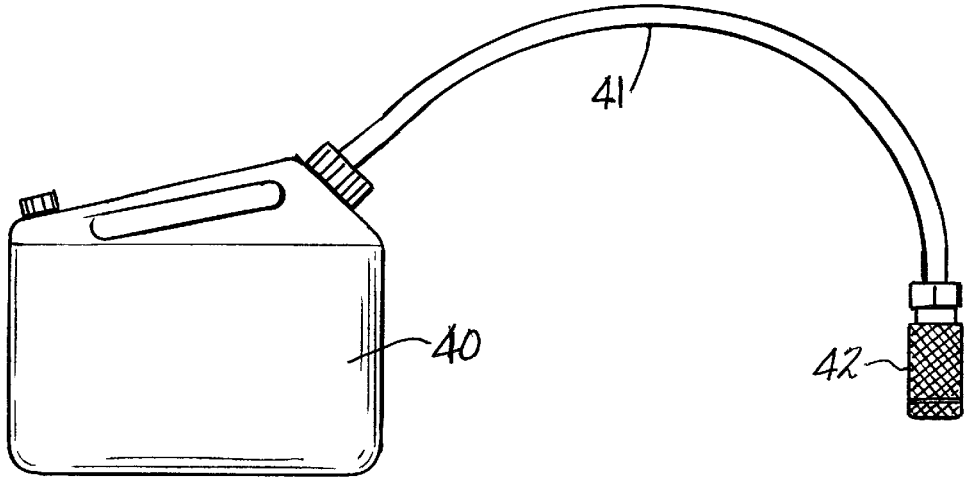
FIG. 5 is a view of a fuel overflow container used in conjunction with the invention.

A fuel overflow container 40 in the form of a small portable tank (FIG. 5) has a flexible line 41 leading therefrom to the female portion 42 of a bayonet type, quick-disconnect coupling which mates with male portion 34 as shown in FIG. 3. The fueling attendant, or the boat owner, connects the coupling members 34 and 42. Then fueling is commenced. Any overflow of fuel through vent line section 26*a* is captured in container 40. When fueling is completed the fuel in container 40 may be emptied into tank 11. A container 40 may be carried on the boat or be standard equipment at a fueling dock, or both. After fueling is completed and any overflow fuel is poured back into tank 11, both of caps 21 and 31 are replaced.

Figure 6:
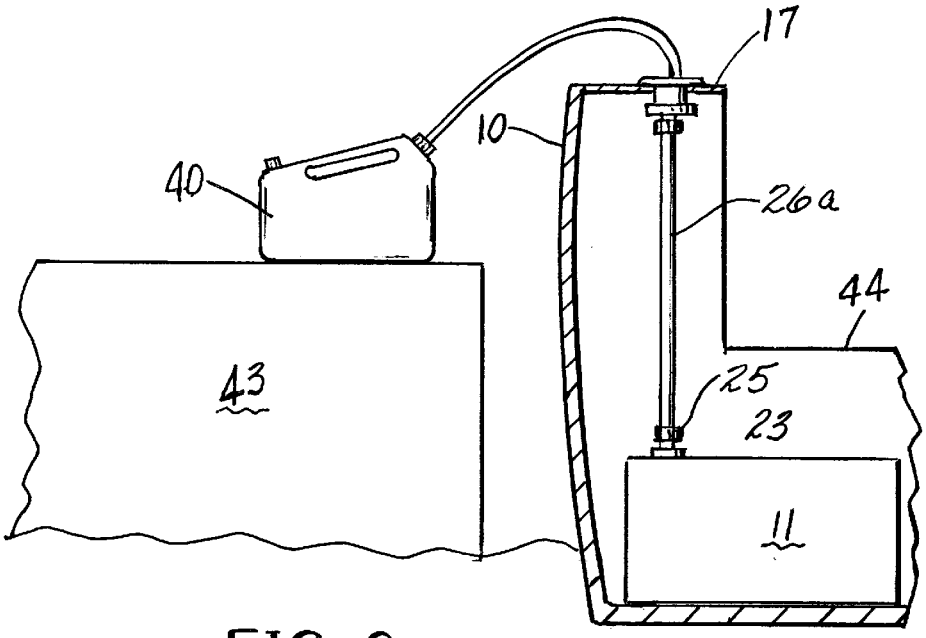
FIG. 6 is view of the overflow container of FIG. 5 connected to a device embodying the invention.

FIG. 6 exemplifies container 40 sitting on a dock 43 where the boat is drawn up for fueling. The container could also be positioned on the deck 44 of boat 10.

The coupling arrangement within member 33 may take any form instead of the bayonet type quick disconnect coupling exemplified. A threaded coupling or a pressure coupling using a rubber or other flexible connector on the end of line 41 may be used.

The fuel tank—vent line arrangement shown for purposes of disclosure as typical, may vary with different boats. The fuel tank filler tube may be a flexible line, as shown, or may be a rigid line as previously mentioned. The vent line sections may be flexible or rigid, usually copper, with mechanical connections as needed.

The invention is adaptable for original installation when a boat is first built and is also easily installed as after market equipment. If installed after construction of the boat, it is only necessary to install a member 33 and re-route the vent line.

While the member 33 has been shown in its prototype form, partially formed with a pipe end piece, it will be understood that member 33 could be formed in one piece with suitable openings and/or nipples (threaded or unthreaded) to receive a connector to catch overflow during fueling. Preferably, tube 37 extends above the bottom of cup-shaped member 33. If there is any overflow of fuel due to heat expansion of fuel when the fuel tank 11 is full or near full, such overflow will be retained in member 33.

The invention also comprises a method of operation. The fuel tank vent line is routed to a location in proximity to the fuel filler fitting, provided with means for interrupting the vent line and connecting an overflow container from the fuel tank vent line to the container and then reconnecting the fuel vent line.

It may thus be seen that the objects of the invention set forth above as well as those made apparent are efficiently attained. While preferred embodiments of the invention have been set forth for purposes of disclosure, modifications to the disclosed embodiments as well as other embodiments of the invention may occur to those skilled in the art. Accordingly, the appended claims are intended to cover all modifications to the disclosed embodiments of the invention as well as other embodiments thereof which do not depart from the spirit and scope of the invention.

What is claimed is:

1. A method of fueling a fuel tank on a boat which includes a fuel tank, a filler tube leading from an accessible fuel filler fitting to the fuel tank and a vent line for the fuel tank to a boat mounted vent comprising the steps of providing a first member having a hollow interior and a removable closure member for said hollow interior in close proximity to said fuel filler fitting, connecting a first section of said vent line to said hollow member from said fuel tank, connecting a second section of vent line between said first member and said hull mounted vent, removing said closure member when said boat is to be fueled and connecting an overflow container to said first section of said vent line in said first member and replacing said closure member when said boat is fueled.

2. For use in combination with a boat having a fuel tank mounted thereon and having a fuel filler fitting and tube leading to the tank from a fuel filler fitting mounted substantially flush with a surface of the boat and a vent line leading from the fuel tank to a boat hull vent extending through the hull of the boat, a first member having a hollow interior mounted substantially flush with a surface of the boat, said first member including a removable closure member, the interior of said first member being accessible when said closure member is removed from said first member, a first nipple extending into the hollow interior of said first member and adapted to receive a first length of the vent line extending from the fuel tank, a second nipple extending into said first member, said second nipple adapted to be connected to a second length of vent line leading from said second nipple to said vent whereby when said closure member is on said first member said fuel tank is in communication with said vent through said vent line lengths and said first member and when said closure member is removed from said first member communication between said fuel tank and said vent is interrupted.

3. The arrangement of claim 1 further including a fuel collection receptacle having a line extending therefrom adapted to be connected to said first nipple whereby when said closure member is removed from said first member and said line is connected to said first nipple the interior of said fuel tank is in communication with said collection receptacle.

4. The combination of claim 1 wherein said first member is adapted to be mounted to the boat in close proximity to the fuel filler fitting.

5. Apparatus for use in the fuel vent line of a boat having a fuel tank mounted thereon and having a fuel filler tube leading thereto from a fuel filler fitting mounted to a surface of the boat, said apparatus being connectable between a first section of boat fuel tank vent line extending from the fuel tank and a second section of fuel tank vent line to a fuel tank vent on the boat, said apparatus comprising a first member having walls defining a hollow interior adapted to be mounted to a surface of a boat, a removable closure member for said first member for enclosing said hollow interior, the interior of said first member being accessible when said closure member is removed from said first member, first means for connecting a first section of said vent line from the fuel tank to the interior of said first member, second means for connecting the interior of said first member to a second section of said vent line leading to said vent, said first means being connectable to a portable fuel overflow container when said closure member is removed from said first member whereby when said first member is mounted to a boat and receives said closure member thereon said fuel tank is vented through said first fuel line vent section, said first member and said second fuel line vent section to said vent and when said closure member is removed from said first member said fuel tank vent line is interrupted.

6. The apparatus of claim 5 wherein said first member has a mounting flange thereon adapted to be secured to a surface of the boat.

7. The apparatus of claim 5 wherein said first means includes a tubular member having a coupling thereon within said first member adapted to be connected to a mating coupling on a fuel overflow container.

8. The apparatus of claim 7 wherein said couplings are a bayonet-type quick disconnect coupling.

9. The apparatus of claim 5 further including a fuel overflow collection receptacle having a line extending therefrom adapted to be connected to said first means whereby when said closure member is removed from said first member and said collection receptacle is connected to said first means the interior of said fuel is in communication with said collection receptacle.

10. The apparatus of claim 5 wherein said first member is adapted to be mounted to the boat in close proximity to the fuel filler fitting of the boat.

11. Apparatus for use in the fuel tank vent line of a power boat and connectable between a first section of fuel tank vent line extending from the fuel tank and a second section of fuel tank vent line extending to a vent on the boat comprising a first member having a hollow interior adapted to be mounted to a surface of a boat, a removable closure member for said first member for enclosing said hollow interior, the interior of said first member being accessible when said closure member is removed from said first member, a first tubular member extending through said first member into said hollow interior and having one end adapted to be connected to a portable fuel overflow container when said closure member is removed from said first member and to said first section of fuel tank vent line at the other end thereof, a second tubular member extending into a wall of said first member and in communication with said hollow interior, said second tubular member adapted to be connected to said section of fuel tank vent line whereby when said first member is mounted to the boat and receives said closure member thereon said fuel tank is vented to said vent through said first and second sections of fuel tank vent line and the interior of said first member and when said closure member is removed from said first member said fuel tank vent line is interrupted.

12. The apparatus of claim 11 wherein said first member has a mounting flange thereon adapted to be secured to a surface of a boat.

13. The apparatus of claim 11 wherein said first tubular member includes a coupling thereon within said hollow interior adapted to be connected to a mating coupling on a fuel overflow container.

14. The apparatus of claim 13 wherein said couplings are bayonet-type quick release couplings.

15. The apparatus of claim 12 mounted to a power boat having a fuel filler fitting on a surface of the boat and said first member is mounted on said surface in close proximity to the fuel filler fitting.

* * * * *